United States Patent [19]

Erdelyan

[11] 3,969,835

[45] July 20, 1976

[54] LOCKABLE SUSPENSION SYSTEM FOR A SCRAPER

[75] Inventor: Steven Erdelyan, Glen Ellyn, Ill.

[73] Assignee: International Harvester Company, Chicago, Ill.

[22] Filed: Mar. 5, 1975

[21] Appl. No.: 555,643

Related U.S. Application Data

[63] Continuation-in-part of Ser. No. 437,263, Jan. 28, 1974.

[52] U.S. Cl. ..... 37/129; 267/64 R; 172/705

[51] Int. Cl.[2] ..... E02F 3/62

[58] Field of Search ..... 280/124 R, 124 F, 6.11, 280/489; 37/124, 126 R, 129 R, 129 G, 129 H, 8; 267/61, 64 R, 63, 65, 137, 141, 153, 34, 122

[56] References Cited

UNITED STATES PATENTS

| | | | |
|---|---|---|---|
| 3,158,944 | 12/1964 | Rehberg | 172/705 |
| 3,299,547 | 1/1967 | Gee | 37/129 |
| 3,514,057 | 5/1970 | Biggs | 267/64 X |
| 3,889,404 | 6/1975 | Eftefield | 37/129 |

*Primary Examiner*—Philip Goodman
*Attorney, Agent, or Firm*—William H. Wendell; Floyd B. Harman

[57] ABSTRACT

A lockable suspension system for a scraper which has a tractor and a bowl pivotally connected to each other and pivotally supported by wheels driven by an engine, and hydraulic jacks attached to the bowl for controlling the vertical position of the bowl. The suspension system includes a lever pivotally attached to the hydraulic jacks, a hydraulic ram pivotally attached to the lever, a shock absorber rigidly attached to the tractor and pivotally attached to the hydraulic ram while being pivotally connected to and pivotally supporting the lever, and a controlling means operatively connected to the hydraulic rams whereby the rams can be locked out.

7 Claims, 7 Drawing Figures

LOCKABLE SUSPENSION SYSTEM FOR A SCRAPER

CROSS REFERENCE TO RELATED APPLICATION

This application is a continuation in part of my application Ser. No. 437,263, filed Jan. 28, 1974.

BACKGROUND OF THE INVENTION

This invention relates generally to suspension systems for scrapers and, more particularly concerns suspension systems which will dampen the shock loads during transport while acting as rigid connections during the digging operations of the vehicle.

The function of a scraper vehicle is to uniformly and efficiently remove a layer of earth from one section of land and transport the earth to another section. During the removal process the vertical attitude of the scraper bowl must be locked at a specified height to insure uniform earth removal. This locking of the bowl position is normally accomplished through the use of hydraulic jacks which connect the tractor to the bowl. However, during the transporting procedure the flexibility of the tires, the great weight of the vehicle and its carried load and the speed of transport all combine to produce a bouncing movement of the entire vehicle. This bouncing causes high loads on the structural members, decreases the control which the operator has over the vehicle's motion and increases the operator's discomfort by jarring him severely.

The existing systems which attempt to control the bounce during transporting utilize gas compression to cushion the load transferred between the bowl and the tractor. By using gas compression to control the bounce of the vehicle, the effectiveness of the existing systems are limited by the inherent physical characteristics of gas compression. The first such limitation is the expense and the limited durability caused by the complexity of the physical components necessary to separate the hydraulic fluid from the gas in the system while keeping the gas system responsive to the hydraulic system. The second limitation is the limited effectiveness of the cushioning action that results from the heat generated in the compressing of the gas increasing the temperature of the gas system which increases the pressure of the gas system, thereby stiffening the connection between the bowl and the tractor by unnecessarily increasing the normally constant spring rate of the system. The third limitation of the gas compression cushioning systems is their marginal acceptability resulting from the doubling of the spring rate when the transporting is done with a loaded bowl. Under these conditions a series of accumulators must be used to provide increased spring rates according to the load carried by the bowl, but the load carrying spring rate is still substantially constant and does not allow for variations in the weight of the carried material.

Accordingly, it is the primary aim of the present invention to provide a lockable suspension system for a scraper which eliminates the transport bounce thereby improving the operator's comfort and decreasing the structural loads on the supporting members.

More particularly, it is object of the invention to provide a suspension system which has a spring rate that is at most nominally effected by temperature variations.

Moreover, an object of the present invention is to have a scraper suspension which functions in both loaded and unloaded conditions while responding to weight variation in the loaded condition.

Finally, an object of the present invention is to have a scraper system whose durability is not effected by the vehicle's rugged working environment or by incompatibility between the bowl control medium and the cushioning medium.

SUMMARY OF THE INVENTION

In accordance with the invention the lockable suspension system for a scraper will function on a vehicle having a tractor and a bowl pivotally connected and pivotally supported by wheels which are powered by an engine, while having hydraulic jacks attached to the bowl for controlling the vertical position of the bowl. The suspension system will include a lever pivotally attached to the hydraulic jacks, a hydraulic ram having a head end and a rod end and pivotally attached to the lever, variable spring rate shock absorber rigidly attached to the tractor and pivotally attached to the hydraulic ram while being pivotally connected to and pivotally supporting the lever, and a control means operably connected to the hydraulic rams for locking said rams.

BRIEF DESCRIPTION OF THE DRAWINGS

Other objects and advantages of the invention will become apparent upon reading the following detailed description and upon reference to the drawings, in which.

While the invention will be described in connection with a preferred embodiment, it will be understood that it is not intended to limit the invention to that embodiment. On the contrary, it is intended to cover all alternatives, modifications, and equivalents as may be included within the spirit and scope of the invention as defined in the appended claims.

DETAILED DESCRIPTION OF THE PREFERRED EMBODIMENT

Figure 1:
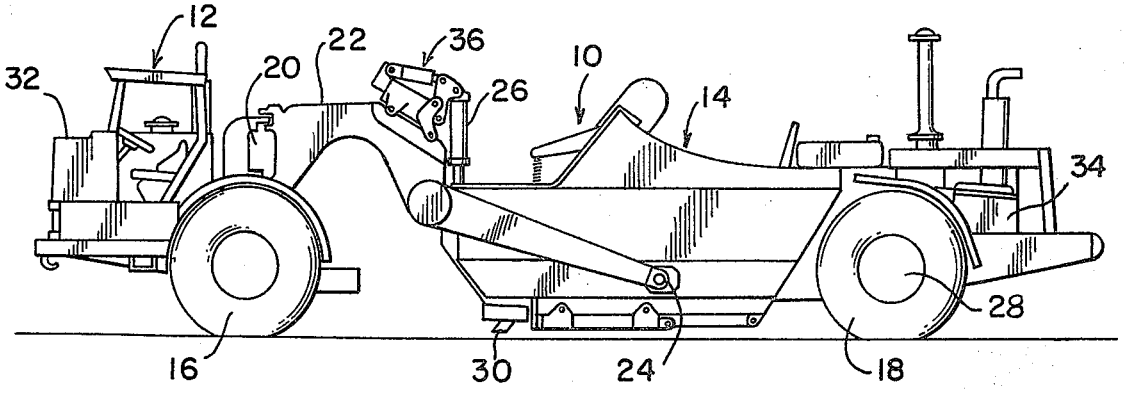
FIG. 1 is a side view of a scraper incorporating the lockable suspension system.

As is depicted in FIG. 1, the preferred embodiments scraper 10 includes a tractor 12 and a bowl 14 pivotally mounted on wheels 16 and 18 respectively. The tractor 12 includes a conventional fifth wheel connection 20 and a gooseneck 22 which is pivotally connected to bowl 14 at pivot 24. The scraper 10 of FIG. 1 is shown in the transport position with the hydraulic jacks 26 retracted to pivot the bowl 14 about its pivotal connection 28 with wheels 18, thereby raising the cutting edge 30 above the ground level. In this transport position the scrapers engines 32 and 34 are used to drive the wheels 16 and 18 thereby moving this scraper from one location to another.

When the scraper is moving from location to location, the weight of the entire vehicle or the combined weight of the vehicle and its carried load (not shown) is large enough to cause elastic deformation of the resilient portion of the wheels 16 and 18 when rough terrain is encountered. During such transporting the hydraulic jacks 26 are rigidly held in their retracted position and make a rigid connection between its tractor 12 and the bowl 14. As a result of this rigid connection the upward forces caused by the wheels 18 returning to their normal position are transferred to the tractor and the scraper 10 experiences a vertical bounce produced by the frequency of the wheeled deflections. As shown in FIG. 1 the present invention interrupts the force transmission between the bowl 14 and the tractor 12 by interposing a lockable suspension system 36 between the hydraulic jack 26 and the gooseneck 22. The lockable suspension system 36 also dampens force transmitted from the tractor to the bowl, thereby eliminating the bounce produced by the tractor and bowl acting as a single mass.

Figure 2:
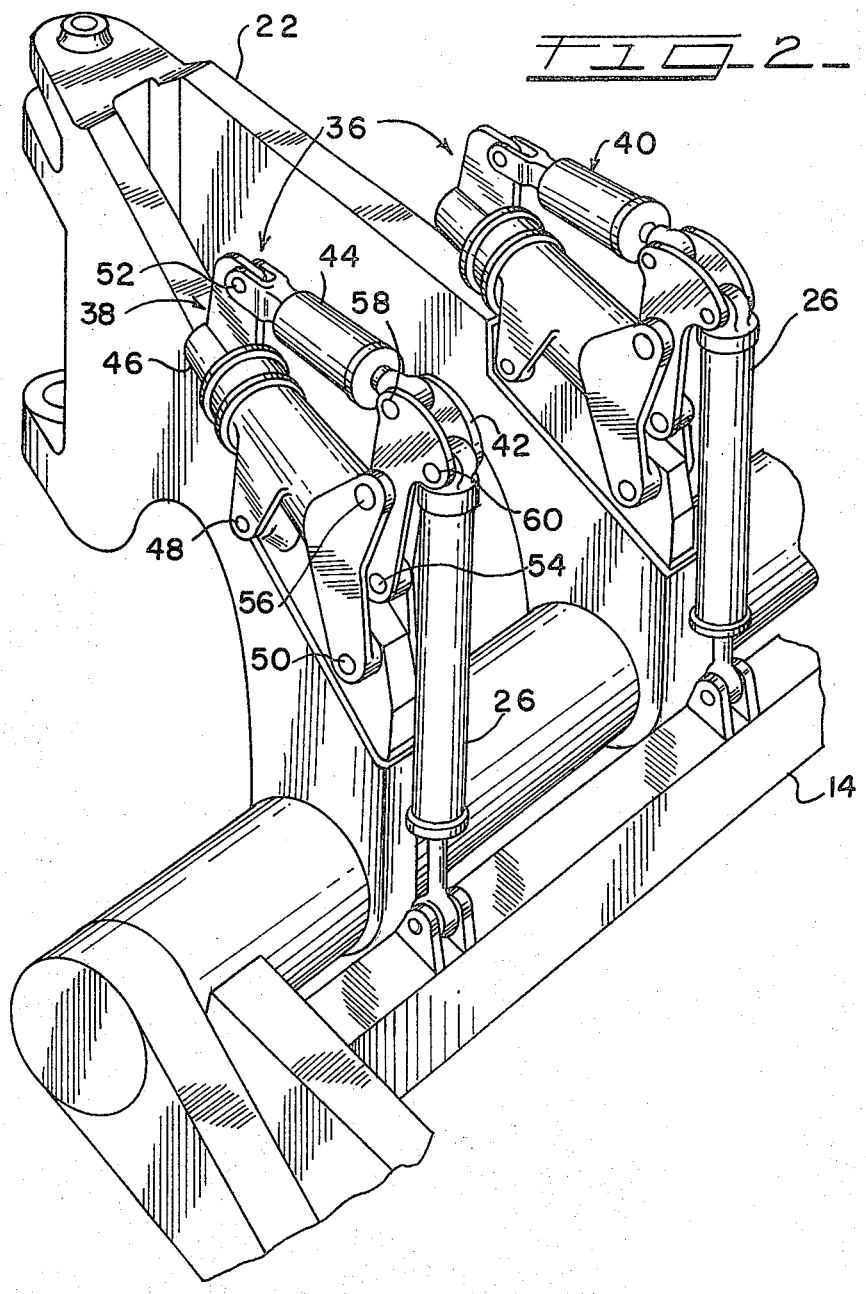
FIG. 2 is a perspective view of the suspension system connecting the tractor to the bowl of the scraper.
Figure 4:
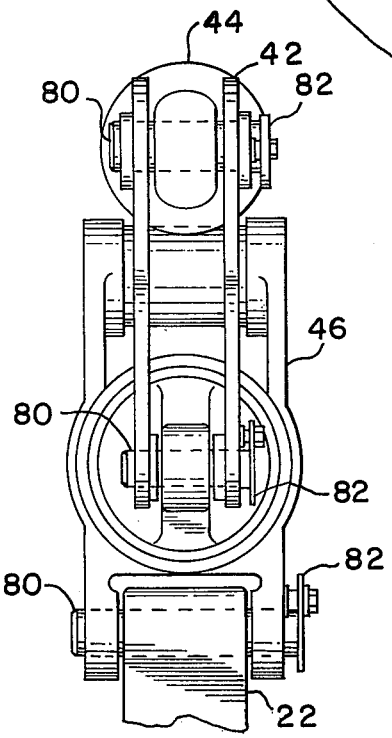
FIG. 4 is an end view of the suspension system along line 4—4 of FIG. 3.
Figure 5:
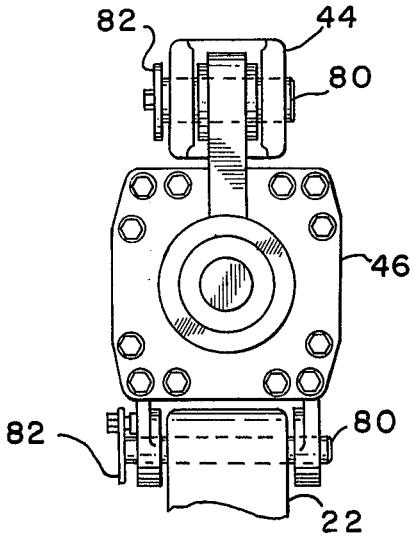
FIG. 5 is an elevation view of the suspension system along line 5—5 of FIG. 3.
Figure 6:
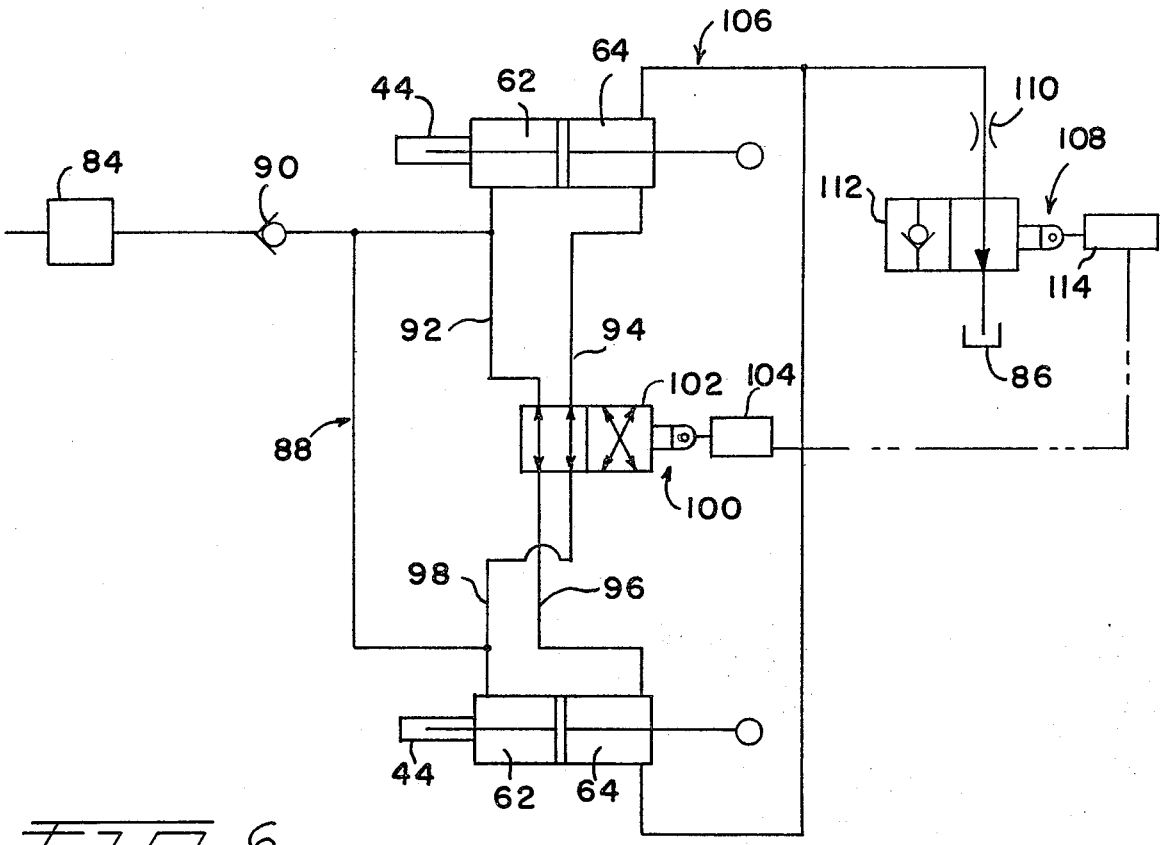
FIG. 6 is a schematic view of the hydraulic circuitry of the preferred embodiment in the cushion mode.
Figure 7:
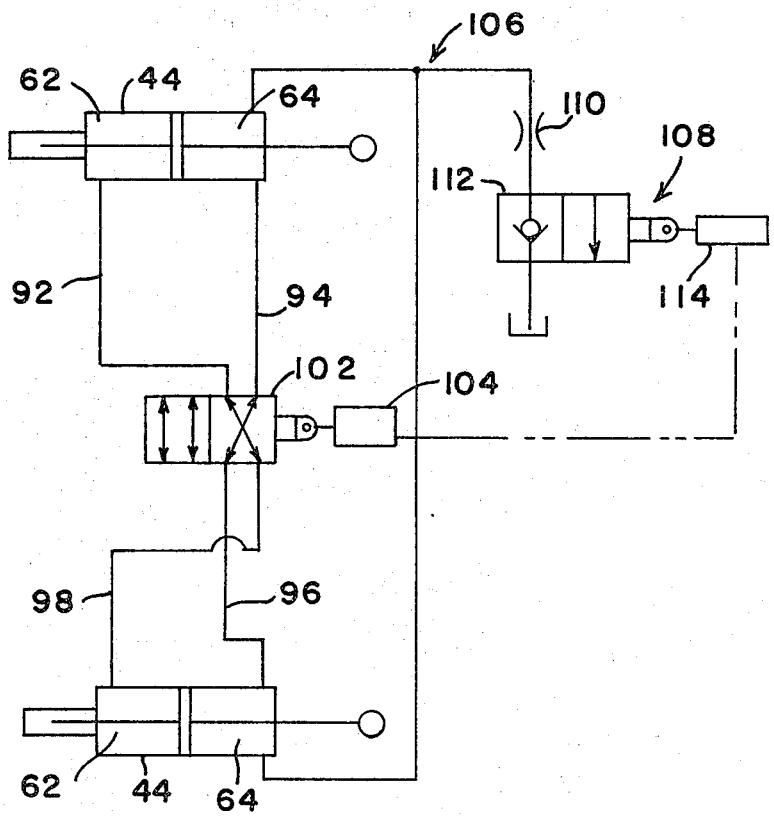
FIG. 7 is a schematic view of the hydraulic circuitry of the preferred embodiment in the lockout mode.

The preferred embodiments configuration of the lockable suspension system is depicted in FIGS. 2, 3, 4, and 5 with the hydraulic circuitry being schemmatically shown in FIGS. 6 and 7. Turning first to FIG. 2, the suspension system 36 includes a symmetrical pair of identical dampener structures 38 and 40, therefore, the remaining description will be restricted to the dampening structure 38. In the illustrated form the dampening structure includes a lever 42, a hydraulic ram 44, a shock absorber 46, and a control means, with the control means being depicted schemmatically in FIG. 6 and 7.

In the particular device illustrated, the shock absorber 46 is rigidly connected to the gooseneck 22 at points 48 and 50. In addition, the shock absorber 46 is pivotally connected to the hydraulic ram 44 at point 52, is pivotally connected to lever 42 at point 54 and pivotally supports lever 42 about axis 56. In the present instance the lever 42 is also pivotally connected to the hydraulic ram 44 at point 58 and to the hydraulic jack 26 at point 60.

Figure 3:
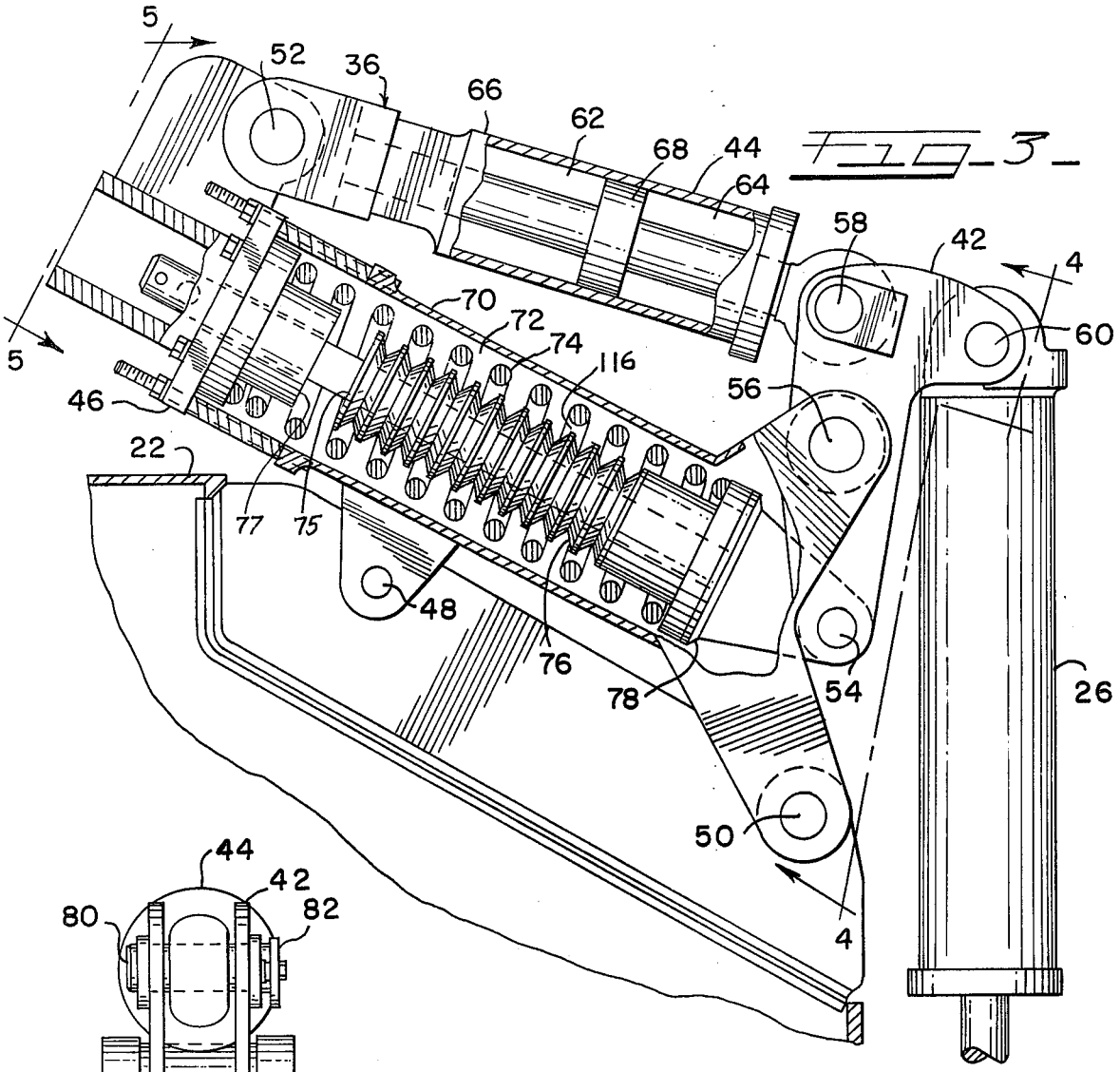
FIG. 3 is a fragmentary section view of the suspension system connecting the tractor to the scraper bowl.

As best shown in FIG. 3, the preferred embodiments hydraulic ram is a double acting ram which defines a head end 62 and a rod end 64. These ends are the force producing sections of the hydraulic rams which have fluid containing volumes established by the rams cylinder 66 and the piston rod 68. In the illustrated construction the piston rod 68 is pivotally connected to the lever 42 and slidably mounted in the cylinder 66 with the cylinder 66 being pivotally connected to the shock absorber 46.

The preferred embodiments shock absorber 46 is also best shown in FIG. 3. Preferably the shock absorber 46 includes a housing 70 having a bore 72, a spring 74 and a series of elastomer pads 76 supported within the bore 72 by rod means 78. The housing 70 is rigidly connected to the gooseneck 22 at points 48 and 50, is pivotally connected to hydraulic ram 44 at point 52 and pivotally supports lever 42 at point 56. The rod means 77 is slidably supported within bore 72 and pivotally attached to lever 42 at point 54. It is evident that the hereinbefore set forth pivotal and rigid connections can be accomplished through a variety of conventional connecting devices. In the illustrated construction the connecting method used is pins 80 having extensions 82 slidably connected to the shock absorber 46, the lever 42, or the hydraulic ram 44, as depicted in FIGS. 4 and 5.

In keeping with the invention the lockable suspension system 36 also includes a control means, shown schematically in FIGS. 6 and 7, which establishes the flow of hydraulic fluid between the charge pump 84, the hydraulic rams 44, and the hydraulic fluid reservoir 86. The charge pump 84 is hydraulically connected to the hydraulic rams 44 by a first conduit system 88, which includes a check valve 90 that permits fluid to pass from the charge pump 84 to the hydraulic rams 44 only upon a pressure drop in the rams. The conduit system 88 includes a first conduit 92, a second conduit 94, a third conduit 96, and a fourth conduit 98 which can connect the hydraulic rams 44 in either a head end 62 to head end 62 and rod end 64 to rod end 64 fluid communication or a head end 62 to rod end 64 communication.

Interposed in the first conduit system between the hydraulic rams 44 is a first control mechanism 100 that determines which of the previously mentioned fluid communications exist between the hydraulic rams 44. The first control mechanism 100 includes a first spool means 102 capable of establishing either a head end 62 to head end 62 or a head end 62 to rod end 64 communication between the hydraulic rams 44, and an actuator means 104 which controls the position of first spool means 102 thereby determining the communication between the hydraulic rams 44. In the preferred embodiment the actuator means 104 consists of a high pressure air system that the operator controls from the cab to establish the fluid connection between the rams. It is obvious, however, that many conventional actuating means could be used such as a Bowden cable connection or a mechanical linkage arrangement responsive to motion of the hydraulic jack 26.

In the schematic representations of the hydraulic control circuit, FIG. 6 shows the hydraulic rams 44 fluidly communicating from head end 62 to rod end 64, while FIG. 7 depicts the fluid communication between head ends 62 of the hydraulic rams 44. Turning to FIG. 6, the preferred embodiments second conduits system 106 and second control mechanism 108 are shown connecting the rod ends 64 of the hydraulic rams 44 to the hydraulic reservoir 86. With the system in the head end 62 to rod end 64 or cushion position, the relative motion between the tractor 12 and the bowl 14 produces sliding motion of the piston rod 68. This motion causes hydraulic fluid to pass from the head end 62 of one hydraulic ram to the rod end 64 of the opposite hydraulic ram. During the passage of this hydraulic fluid through the conduits the energy of the relative motion is partially converted into heat in the hydraulic system which increases the pressure of the system. In carrying out the invention a restriction 110 is formed in the second conduit system to permit bleed off of hydraulic fluid under the higher pressure caused by the energy absorbed in the dampening process.

The second control mechanism 108 depicted in both FIGS. 6 and 7 includes a second spool means 112 and a selector means 114. The second spool means 112 is capable of either permitting flow from the second conduit system 106 to the hydraulic reservoir 86 or blocking this flow. In FIG. 7 the control system is shown in the lockout mode with the first spool means 102 connecting the head ends 62 of the hydraulic rams 44. With this fluid communication established, the communication between the second conduit system 106 and the hydraulic reservoir 86 must be blocked by the second spool means 112 to insure that the piston rod 68 will not move within the cylinder 66 of the hydraulic ram 44. In the preferred embodiment the selector means 114 is a mechanical arrangement which the operator activates at the same time that he activates the actuator means 104. It will be apparent that alternative methods of controlling the position of the second spool means 112 are available, eg. Bowden cable or a mechanical system responsive to the motion of the actuator means 104 as shown in phantom in FIGS. 6 and 7.

In keeping with one of the principal objects of the invention, when the lockable suspension system 36 is in its cushion mode the relative motion between the tractor 12 and the bowl 14 produces a rotation of lever 42 about its axis 56. The forces transmitted through lever 42 are dampened by the heating of the hydraulic fluid mentioned in the previous paragraph and by the compression of spring 74 and the elastomer pads 76 within shock absorber 46. When the relative motion arises during the moving of an unloaded scraper, the spring 74, having a known spring rate which is constant, provides the dampening. However, when the scraper is carrying earth in the bowl, the loads transmitted through lever 42 are appreciably higher than those transmitted in the empty transporting situation, thereby compressing spring 74 until the elastomer pad's top end 75 contacts stop 77 and both provide the dampening. With larger compressing forces acting on both the elastomer pads 76 mounted within the internal space 116 of spring 74 and the spring 74, the elastomer pad's variable spring rate is added to the constant spring rate of spring 74. Since the pad's spring rate increases asymptotically as it is compressed, the system's spring rate increases as the weight of the carried load increases and insures optimum cushioning under all conditions.

Thus, it is apparent that there has been provided in accordance with the invention, a lockable suspension system for a scraper that eliminates the transport bounce of the vehicle, minimizes the complexity of the system thereby increasing its durability and decreasing its expense, has a spring rate which is only nominally effected by the heat produced during that operation of the system and that has a spring rate responsive to the variations in the weight of the carried material. While the invention has been described in conjunction with specific embodiments thereof, it is evident that many alternatives, modifications, and variations will be apparent to those skilled in the art in light of the foregoing description. Accordingly, it is intended to embrace all such alternatives, modications, and variations as fall within the spirit and broad scope of the appended claims.

What is claimed is:

1. A lockable suspension system for a scraper having a tractor and a bowl pivotally connected and pivotally supported by wheels powered by an engine and a hydraulic jack attached to said bowl for controlling the vertical position of said bowl, said system comprising, in combination:

a lever pivotally attached to said hydraulic jack;

a hydraulic ram having a head end and a rod end, and pivotally attached to said lever;

a variable spring rate shock absorber rigidly attached to said tractor, pivotally attached to hydraulic ram, and pivotally supporting and connected to said lever; and a control means operably connected to said hydraulic rams for neutralizing the variable spring rate shock absorber by locking said rams.

2. The lockable suspension of claim 1 further defined by including:

a series of at least two levers;

a series of at least two hydraulic rams; and a series of at least two shock absorbers.

3. The lockable suspension system of claim 2 wherein said control means includes:

a hydraulic fluid reservoir;

a charge pump operably connected to said engine and said reservoir;

a first conduit system connecting said charge pump and said hydraulic ram;

a first control mechanism interposed in said conduit system including;

first spool means interposed in said conduit system for selectively hydraulically connecting said head ends to said rod ends, and connecting said rod ends to said rod ends and said head ends to said head ends;

actuator means operably connected to said spool means for controlling said selection of said hydraulic connection;

a second conduit system connecting said hydraulic rams and said reservoir;

a second control mechanism interposed in said second conduit system including;

second spool means interposed between said rams and said reservoir for selectively connecting said rams and said reservoir, and blocking said ram and reservoir connection; and selector means operably connected to said second spool means for selecting said connection between said rams and said reservoir.

4. The lockable suspension of claim 1 wherein said variable spring rate shock absorber includes:

a housing having a bore rigidly attached to said tractor, pivotally attached to said hydraulic ram and pivotally supporting said lever;

a spring support by said housing and responsive to motion of said lever;

a series of elastomer pads responsive to motion of said lever and supported within said bore; and rod means slideably supported within said bore and pivotally attached to said lever for supporting said elastomer pads.

5. The lockable suspension of claim 4, wherein said spring is supported by said rod within said bore and defines an internal space and said series of elastomer pads is supported within said internal space.

6. The lockable suspension of claim 4 further defined by including:

a series of at least two levers;

a series of at least two hydraulic rams; and a series of at least two shock absorbers.

7. The lockable suspension system of claim 6 wherein said control means includes:

a hydraulic fluid reservoir;

a charge pump operably connected to said engine and said reservoir;

a first conduit system connecting said charge pump and said hydraulic rams;

a first control mechanism interposed in said conduit system including;

first spool means interposed in said conduit system for selectively hydraulically connecting said head ends to said rod ends, and connecting said rod ends to said rod ends and said head ends to said head ends;

actuator means operably connected to said spool means for controlling said selection of said hydraulic connection;

a second conduit system connecting said hydraulic rams and said reservoir;

a second control mechanism interposed in said second conduit system including;

second spool means interposed between said rams and said reservoir for selectively connecting said rams and said reservoir, and blocking said ram and reservoir connection; and selector means operably connected to said second spool means for selecting said connection between said rams and said reservoir.

* * * * *